US006626971B1

(12) United States Patent
Forbert et al.

(10) Patent No.: US 6,626,971 B1
(45) Date of Patent: Sep. 30, 2003

(54) METHOD AND DEVICE FOR PROTECTING PERSONS AND/OR PRODUCTS FROM AIR-BORNE PARTICLES

(75) Inventors: Rainald Forbert, Flörsheim (DE); Lothar Gail, Wiesbaden (DE); Ekkehard Eigenherr, Kelkheim (DE)

(73) Assignee: Siemens Axiva GmbH & Co. KG (DE)

( * ) Notice: Subject to any disclaimer, the term of this patent is extended or adjusted under 35 U.S.C. 154(b) by 0 days.

(21) Appl. No.: 09/787,040

(22) PCT Filed: Sep. 1, 1999

(86) PCT No.: PCT/EP99/06418

§ 371 (c)(1),
(2), (4) Date: Jun. 22, 2001

(87) PCT Pub. No.: WO00/16017

PCT Pub. Date: Mar. 23, 2000

(30) Foreign Application Priority Data

Sep. 15, 1998 (DE) ..... 198 42 179

(51) Int. Cl.[7] ..... B08B 15/02

(52) U.S. Cl. ..... 55/385.2; 55/DIG. 18; 55/DIG. 46; 454/56; 454/57; 454/61; 454/187

(58) Field of Search ..... 55/385.1, 385.2, 55/DIG. 18, DIG. 46; 454/57, 187, 56, 61

(56) References Cited

U.S. PATENT DOCUMENTS

| | | | | | |
|---|---|---|---|---|---|
| 3,397,631 | A | * | 8/1968 | Simons | 454/190 |
| 3,494,112 | A | * | 2/1970 | Deckas | 55/470 |
| 3,511,152 | A | * | 5/1970 | Truhan | 396/33 |
| 3,803,995 | A | * | 4/1974 | Allander | 454/187 |
| 3,806,720 | A | * | 4/1974 | Hortig | 454/187 |
| 4,676,144 | A | * | 6/1987 | Smith, III | 454/187 |
| 4,838,150 | A | * | 6/1989 | Suzuki et al. | 454/187 |
| 5,665,128 | A | * | 9/1997 | Peters et al. | 55/385.2 |
| 5,997,399 | A | * | 12/1999 | Szatmary | 454/187 |

FOREIGN PATENT DOCUMENTS

| | | |
|---|---|---|
| DE | 4209297 | 9/1993 |
| EP | 0139128 | 5/1985 |
| WO | 91/05210 | 4/1991 |

* cited by examiner

*Primary Examiner*—Duane Smith
*Assistant Examiner*—Minh-Chau T. Pham
(74) *Attorney, Agent, or Firm*—Connolly Bove Lodge & Hutz LLP

(57) ABSTRACT

The invention relates to a method and a device for separating at least two physical areas (1, 2) and for reducing the transmission of air-borne particles between said physical areas so as to protect persons and/or products (26) from said air-borne particles. The persons is located at least partly in the first physical area (1) and the products (26) in the second physical area (2) and at least one flat jet (13) of purified air is used to separate the two areas. The invention is characterized in that at least one low-turbulence displacement air stream (14) of purified air is generated at least in the second physical area (2) near the at least one air jet (13) and said at least one displacement air stream is directed primarily in the same direction as the at least one air jet (13).

25 Claims, 6 Drawing Sheets

17
21
13
14
1
2
16
26
18
15

METHOD AND DEVICE FOR PROTECTING PERSONS AND/OR PRODUCTS FROM AIR-BORNE PARTICLES

The invention relates to a method for separating at least two spatial areas and for reducing the transmission of airborne particles between the spatial areas in order to protect persons and/or products from the airborne particles, the person being located at least in part in the first spatial area and the products in the second spatial area, and at least one planar air jet of purified air being used for the separation.

The invention further relates to devices for carrying out the method.

Products within the meaning of this application are all articles, starting products, intermediate products and end products which are in any way handled, filled, tested or modified.

In many industries, for example in the manufacture of pharmaceuticals and electronics components, either the product has to be protected from airborne foreign particles or the persons involved in the operating process have to be protected from airborne product particles. It is also common for both protective functions, for product and persons, to have to be provided.

Such devices (also called safety workbenches depending on their size and design) operating according to the laminar flow principle are known from the prior art, which devices, in order to protect personnel or products, permit only limited access to the product space. This principle is employed, for example, in the HERAsafe® cytostatic safety workbenches according to DIN 12980 and in the LaminAir® workbenches from the company Heraeus Instruments GmbH, Hanau. Filtered air is delivered in the form of a vertical, low-turbulence displacement stream onto the top surface of the workbench and is suctioned off at the base in front of the rear wall of the workbench and at the front behind the front boundary of the workbench. The front has a vertically displaceable protective screen. When the protective screen is fully or partly raised, outside air flows into the workbench through the access port of the workbench, and this air is likewise suctioned off via the suction arrangements on the base. A disadvantage of these devices is that the narrow access into the product space greatly restricts the operator's freedom of movement. Maneuvers requiring greater freedom of movement than these devices permit in the operating state cannot be performed in such devices unless the protective screen is raised above the correct operating position or is completely removed, as a consequence of which the protection of persons and products is no longer ensured to the full extent.

Devices operating according to the laminar flow principle are also known, which devices do not spatially separate the product from the personnel. This principle is employed, for example, in the Dispensing Booths from the company Extract Technology Limited, Huddersfield, England. Purified air is delivered, for example in the form of a vertical, low-turbulence displacement stream, to the top of the booth and is suctioned off at the base area. A disadvantage of these devices is that the product can only be handled well below the head level of the personnel if protection of the personnel from the product is to be guaranteed. A further disadvantage is that the product in these devices is not adequately protected from foreign particles caused by the personnel.

Moreover, devices operating according to the laminar flow principle are known in which only the product is protected, not the operating personnel. This principle is employed, for example, in the horizontal laminar flow workbenches from the company Babcock-BSH, Bad Hersfeld, Germany. Purified air is delivered horizontally behind the product space in the direction of the personnel. A disadvantage of these devices is the total lack of protection of the personnel.

Devices operating according to the support jet principle are also known which protect only the personnel. This principle is employed, for example, in the WIBOjekt® work tables from the company GWE, Hude. The operating personnel pass their hands through a support jet which is delivered via an ejector rail in the front area of the work table and generates a curtain of air between the head level of the operator and the product space. Further support jets can also be directed from the ceiling to the rear area of the work table. In this principle, the suctioning arrangements are located in the rear area of the work table. The air capacity of the support jet is typically 1 to 10 liters per second per meter of booth width. A disadvantage of these devices is the lack of product protection.

Against the background of this prior art, the object of the invention was to develop alternative methods and devices for protecting persons and products from airborne particles, and which methods and devices will not have the disadvantage of significantly restricting the freedom of movement of the operating personnel.

According to the invention, this object is achieved by a method of the type specified in the introduction, in which at least one low-turbulence displacement stream is generated with purified air near the at least one air jet in at least the second spatial area, said at least one displacement stream being directed in essentially the same direction as the at least one air jet.

The subject of the invention is therefore a method for separating at least two spatial areas and for reducing the transmission of airborne particles between the spatial areas in order to protect persons and/or products from the airborne particles, the person being located at least in part in the first spatial area and the products in the second spatial area, and at least one planar air jet of purified air being used for the separation, wherein at least one low-turbulence displacement stream is generated with purified air near the at least one air jet in at least the second spatial area, said at least one displacement stream being directed in essentially the same direction as the at least one air jet.

A "low-turbulence displacement stream" within the meaning of the invention is a stream in which a unidirectional air stream flows over the whole cross section of a defined area with as far as possible a uniform velocity and almost parallel flow lines (laminar flow). This definition is taken from the guidelines of the Verein deutscher Ingeniouje (VDI) No. 2083 of December 1976, which are thus by reference a constituent part of the description.

A further subject of the invention is a device for carrying out this method, having one or more first means for generating one or more planar air jets, with which, in its intended use, at least one space is divided into at least a first spatial area and a second spatial area by means of the planar air jet or by means of each planar air jet, and products being able to be arranged in the second spatial area, the device in the second spatial area having second means for generating a low-turbulence displacement stream.

Particular embodiments or designs are disclosed in the respective subclaims. It is also possible for one or more of the features disclosed in the subclaims, in combination with the features of the main claims, to represent inventive solutions to the object on which the invention is based, and the features can also be combined in any desired way.

In a first preferred embodiment of the method according to the invention, the displacement stream is guided at least partially at a distance of at most 0 to 50 cm from the at least one air jet. A displacement stream with an air velocity of 0.1 to 1.5 m/s, preferably 0.2 to 0.6 m/s, especially preferably 0.3 to 0.45 m/s, is advantageously generated, likewise at least one air jet with an air outlet velocity of 2 to 30 m/s, preferably 3 to 10 m/s, especially preferably 5 to 8 m/s. In a further preferred embodiment, an air jet or a displacement stream is generated with an air outlet capacity of at least 10 li.N. (liters in norm) per second per meter breadth of the air jet transverse to the direction of flow, preferably 10 to 300 li.N., especially preferably 20 to 100 li.N., very especially preferably 40 to 80 li.N. At least the second spatial area can have zones which are not traversed by the air stream. In a further particular embodiment, at least the total air quantity of the at least one air jet and of the at least one displacement stream is suctioned off in at least one of the spatial areas. It is also advantageous for the air jet or each air jet to be oriented at a predetermined or selectable or adjustable angle, from the range of −45° to +45°, preferably −30° to +30°, especially preferably −15° to +15°, very especially preferably −5° to +5°, toward a lateral face of the displacement stream, relative to the direction of flow.

Preferred configurations of the device according to the invention for carrying out the method can also be constructed accordingly.

In one preferred configuration of the device according to the invention, said device has one or more suction arrangements which are dimensioned such that altogether they can suction off at least the total air quantity of the air jets and of the displacement streams. The suction arrangement or each suction arrangement is preferably arranged opposite the first means for generating the air jets or the displacement flow.

The subject of the invention also includes a device for protecting persons and/or products from airborne particles, having a partially open front with a height of H [m] for access to the device, two side walls, a rear wall, one or more means for blowing in filtered air, which means are arranged on a side wall, and one or more suction devices, wherein the blowing-in means are designed and arranged, on the one hand (4, 5), such that a planar air jet (13) with an air outlet capacity of in all more than 10 li.N. per second and height H [m] can be guided from the area of one side wall near the front to the other side wall in order to separate the internal space (2) of the device from the surrounding area (1), and, on the other hand (3), such that, on that side of the air jet (13) facing away from the front, a purified, low-turbulence displacement stream (14) can be guided from one side wall to the other, and wherein the suction devices (6) are arranged at least partially in the area of the device near the front and are dimensioned such that altogether they can take up at least the total air quantity of the air jet (13) and of the displacement stream (14).

It is advantageous if the lateral suctioning extends over the entire height H [unit meters] of the access cross section of the device.

It is advantageous for the air jet to be guided at a predetermined or selectable or adjustable angle, from the range of −45° to +45°, preferably −30° to +30°, especially preferably −15° to +15°, very especially preferably −5° to +5°, toward the front face of the displacement stream, relative to the direction of flow.

In a further configuration, the high air capacity of the support jet is achieved by combining a plurality of ejector rails one behind the other, preferably by 2 parallel ejector rails. The ejectors used can include all ejector systems known to the skilled person, for example orifice or slit nozzles.

In a further particular configuration, the suctioning is obtained using two parallel rows of orifices (suction rail) in a side wall at the front boundary (front face) of the device.

In a further particular configuration, the air jet is inclined, at a defined, predetermined or selectable or adjustable angle, from the range of −30° to +30°, preferably −20° to +20°, especially preferably −10° to +10°, very especially preferably −5° to +5°, to the connection plane between ejector rail and suction rail or to the horizontal.

In a further particular configuration, an air jet or a low-turbulence displacement stream with an air velocity of 0.1 to 1.5 m/s, preferably 0.2 to 0.6 m/s, especially preferably 0.3 to 0.45 m/s, can be generated.

In a further particular configuration, the ejectors are suitable for an air outlet velocity of 2 to 30 m/s, preferably 3 to 10 m/s, especially preferably 5 to 8 m/s.

In a further particular configuration, the ejector rails are designed such that they can together generate an air outlet capacity of 10 to 300 liters per second per meter height of that part of the front provided for access, preferably 20 to 100 liters per second per meter height, especially preferably 40 to 80 liters per second per meter height.

This device according to the invention can in particular also be combined with one or more features from the other configurations.

The subject of the invention also includes a device for protecting persons and/or products from airborne particles, having a partially open front with a breadth of B [m] for access to the device, a top, a base, a rear wall, one or more means for blowing in filtered air, which means are arranged on the top, and one or more suction devices, wherein the blowing-in means are designed and arranged, on the one hand, such that a planar air jet with an air outlet capacity of in all more than 10 li.N. per second and breadth B [m] can be guided downward from the area of the top near the front in order to separate the internal space of the device from the surrounding area, and, on the other hand, such that, on that side of the air jet facing away from the front, a purified, low-turbulence displacement stream can be guided downward, and wherein the suction devices are arranged at least partially in the area of the device near the front and are dimensioned such that altogether they can take up at least the total air quantity of the air jet and of the displacement stream.

It is advantageous if the suctioning at the base extends over the entire breadth B [unit meters] of the access cross section of the device.

The air jet and the displacement stream can likewise be guided from the bottom upward counter to the force of gravity. A corresponding device according to claim 23 is also the subject of the invention.

It is advantageous if the low-turbulence displacement stream can be guided at an angle which is inclined −20° to +20°, preferably −10° to +10°, especially preferably −5° to +5°, to the vertical.

In a further configuration, the high air capacity of the support jet is achieved by combining a plurality of ejector rails one behind the other, preferably by 2 parallel ejector rails. The ejectors used can include all ejector systems known to the skilled person, for example orifice or slit nozzles.

In a further particular configuration, the suctioning is obtained using two parallel rows of orifices (suction rail) in the base area at the front boundary (front face) of the device.

It is advantageous if the air jet is inclined, at a defined, predetermined angle, from the range of −30° to +30°, preferably −20° to +20°, especially preferably −10° to +10°, very especially preferably −5° to +5°, to the connection plane between ejector rail and suction rail or to the vertical.

In a further particular configuration, a low-turbulence displacement stream with an air velocity of 0.1 to 1.5 m/s, preferably 0.2 to 0.6 m/s, especially preferably 0.3 to 0.45 m/s, can be generated.

In a further particular configuration, the ejectors are suitable for an air outlet velocity of 2 to 30 m/s, preferably 3 to 10 m/s, especially preferably 5 to 8 m/s.

In a further particular configuration, the ejector rails are designed such that they can together generate an air outlet capacity of 10 to 300 liters per second per meter breadth of that part of the front provided for access, preferably 20 to 100 liters per second per meter breadth, especially preferably 40 to 80 liters per second per meter breadth, with which ranges from other combinations of said limits are also intended to be disclosed.

The device according to the invention can also be combined in any desired way with one or more features from the other configurations.

The invention is based on the surprising effect that the displacement stream stabilizes the planar air jet, so that the protective action of the combination of both is considerably better than expected.

It is especially surprising that, for example, the front boundary screen of a horizontal laminar flow work zone, which allows only limited access to the product space, can be replaced by a broad support jet with high air capacity if the suctioning is largely limited to the area of the device near the front, and that then, despite the boundary screen being removed, both a high level of product protection and a high level of personnel protection are guaranteed.

The advantages of the devices according to the invention are to be seen in the fact that while the operating personnel are allowed the greatest possible freedom of movement, the protection of persons and products from airborne particles is guaranteed.

The device according to the invention is explained in more detail on the basis of a number of examples and with reference to FIGS. 1 to 5. This is not intended in any way to limit the scope of the invention.

Figure 4A:
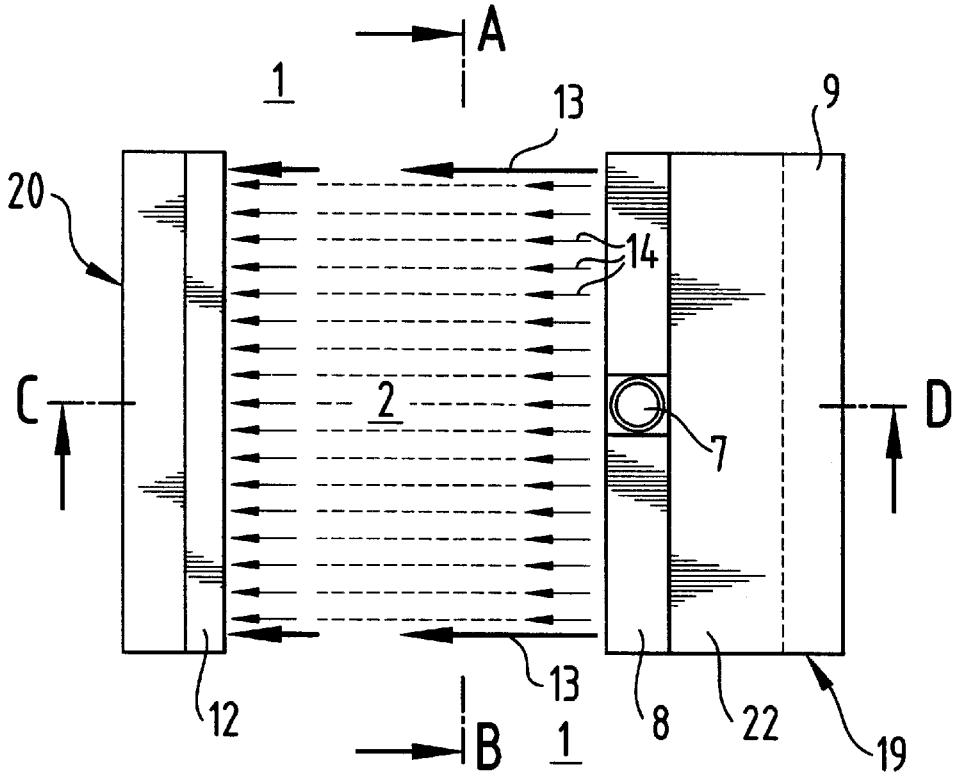
Figure 4B:
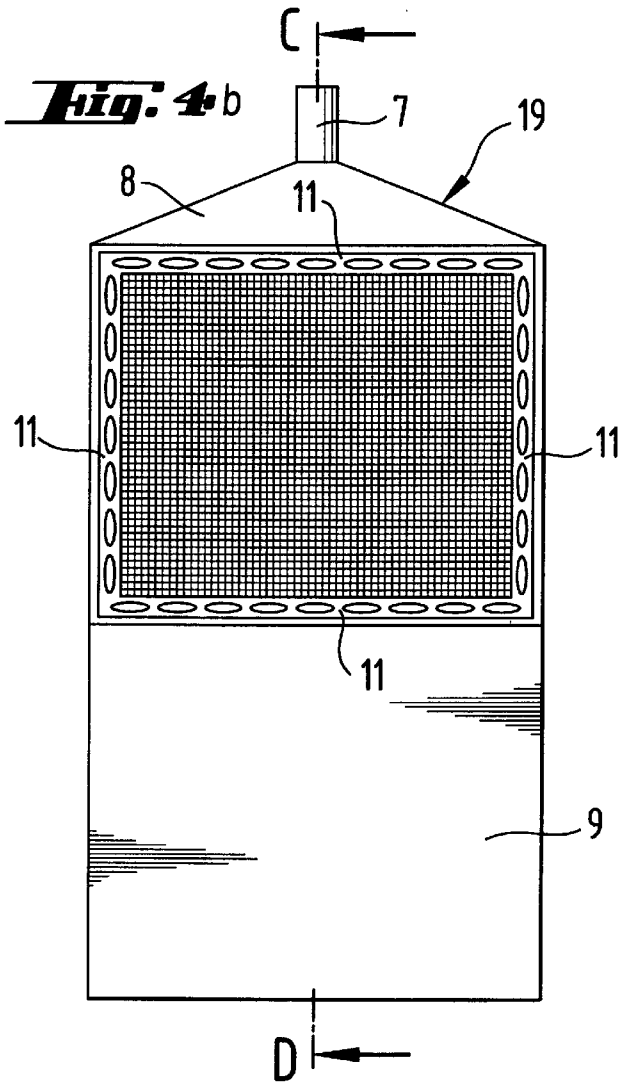
Figure 4C:
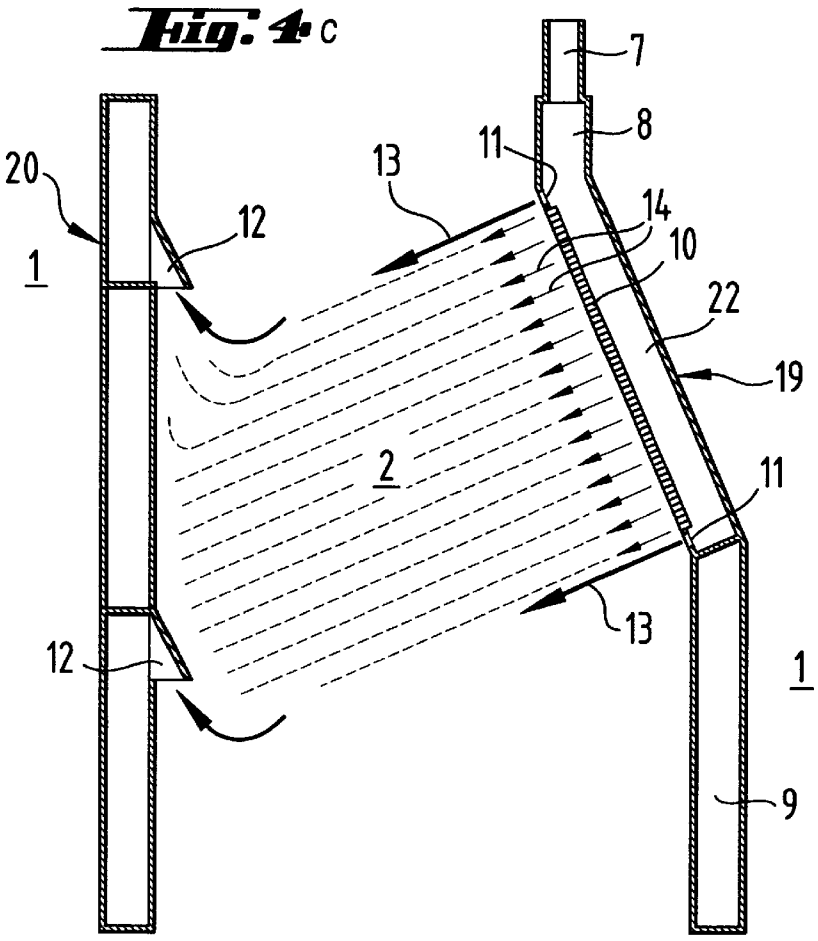
Figure 5:
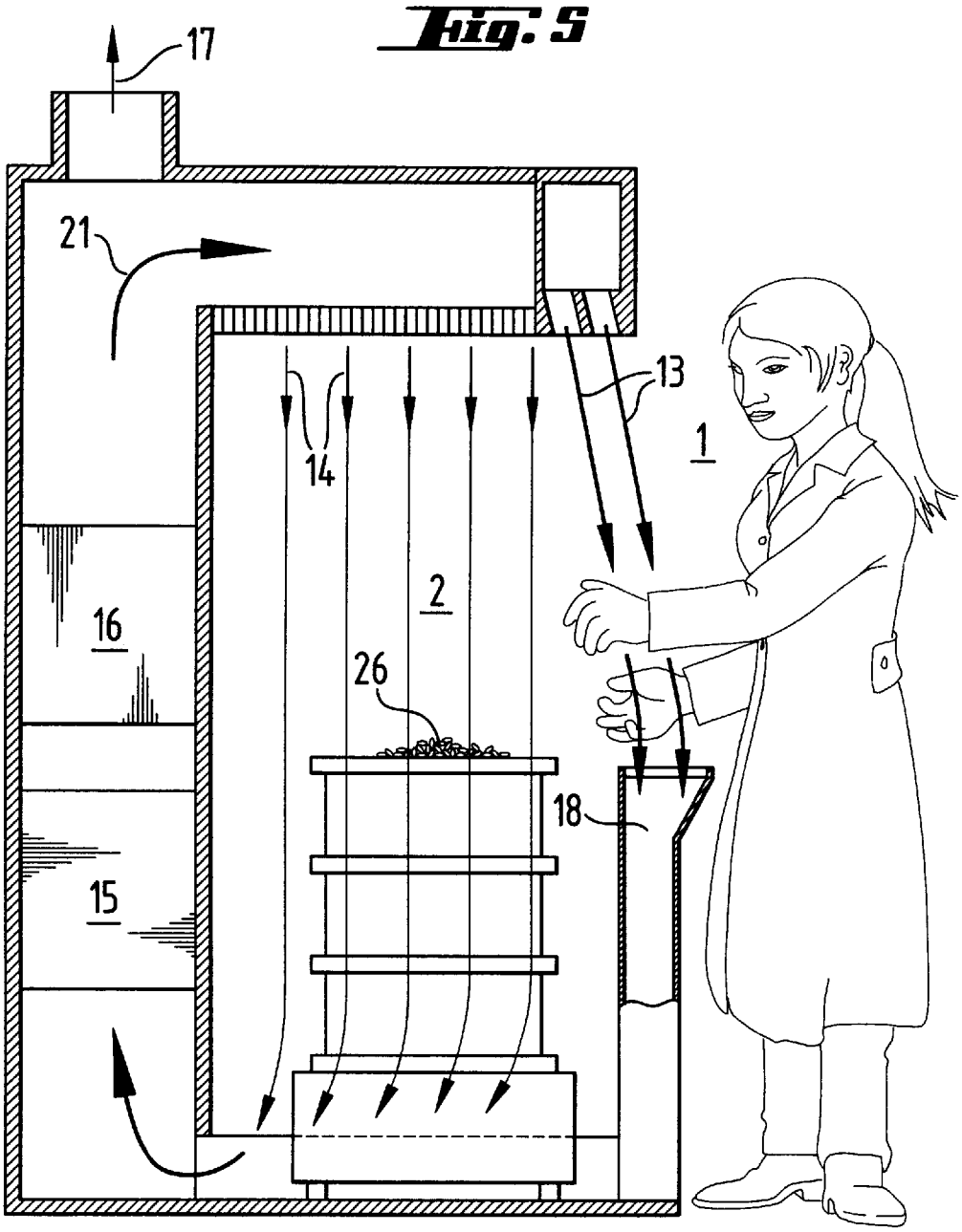

FIG. 4*a* shows a diagrammatic representation of a first particular embodiment of the method and of the device in a plan view;

FIG. 4*b* shows a cross section through the device from FIG. 4*a* along the line A–B;

FIG. 4*c* shows a cross section of the device from FIG. 4*a* along the line C–D;

FIG. 5 shows a diagrammatic representation of a second particular embodiment of the method and of the device in a lateral cross section.

EXAMPLE 1

A LaminAir® workbench, type HL 2472, with a protected product area (corresponds to the second spatial area) 2 and surrounding personnel area 1 (corresponds to the first spatial area) is equipped at the top with second means for generating a low-turbulence displacement stream 14, namely with two-layer laminar flow generators 3 which are sealed off against the workbench walls except for a gap, the breadth of the workbench and 8 mm deep, at a front screen 25. The diagramatically illustrated screen 25 of the workbench is raised as far as the lower edge of the laminar flow generators. Arranged at the height of the lower edge of the laminar flow generators, directly from outside on the raised workbench screen, there are first means 4, 5 for generating a planar air jet 13, namely an ejector rail 4 the breadth of the workbench, and a gap 5 with downward air outlet. The ejector 4 is equipped with a combination of orifice and slit nozzles with an effective cross section of 0.9 mm. The resulting gap 5 between laminar flow generators 3 and raised screen serves as an 8-mm wide ejector 5 with downwardly directed air outlet.

The base of the workbench is sealed off except for the suction openings 6 on the open screen. The laminar flow generators 3 are in this example operated at an air outlet velocity of about 0.45 m/s.

Figure 1:
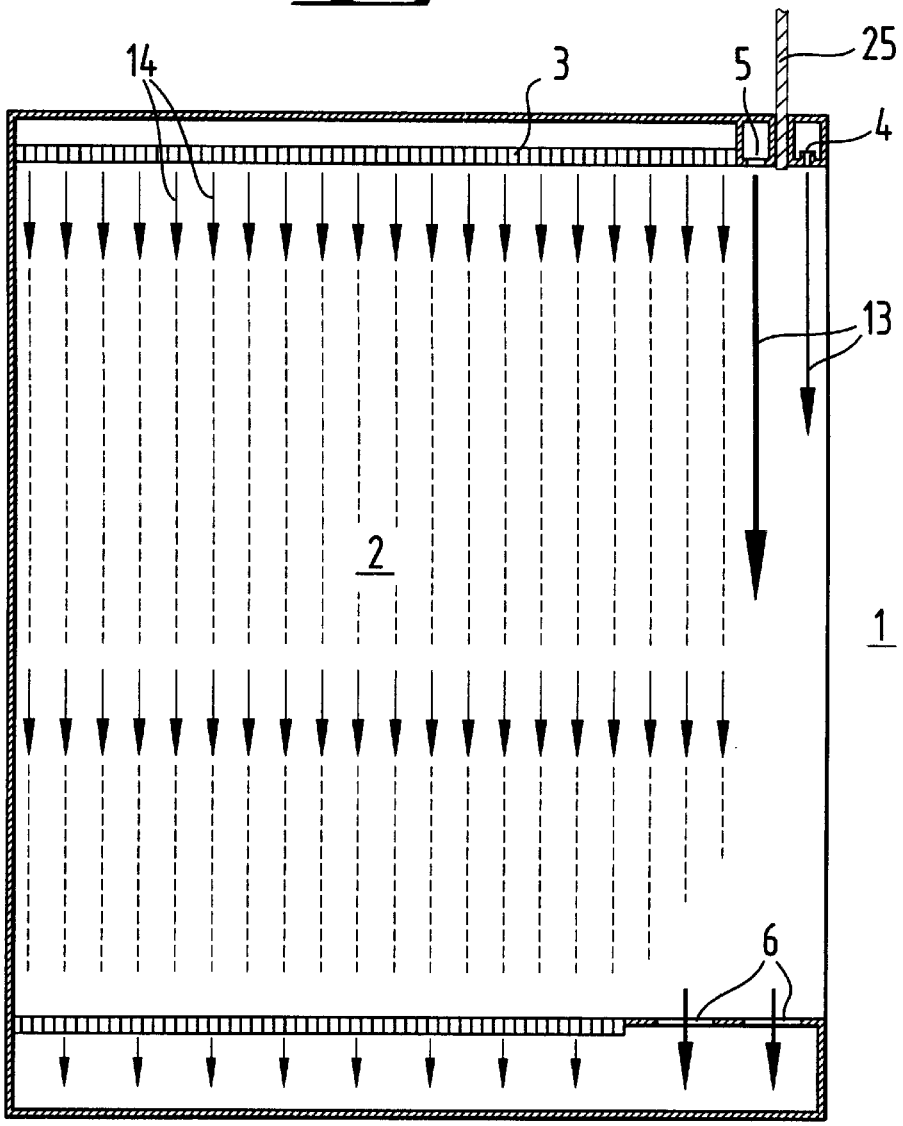
FIG. 1 shows a diagrammatic representation of the method according to the invention, using a device according to the invention represented diagrammatically in cross section.

Ejector 4 in this example is operated at an air outlet velocity of 5 m/s. Ejector 5 in this example is operated at an air outlet velocity of 7 m/s. The planar air jet 13, which is generated by the two ejectors 4, 5, consequently has an air outlet capacity of 46 li.N. per second and meter breadth of the air jet 13. The air distribution in the workbench is shown diagrammatically in FIG. 1 in cross section. The arrows 14 below the laminar flow generators 3 indicate the low-turbulence displacement stream of uniform velocity and with parallel flow lines.

Protection factors are determined below by measurements. The protection factor is defined as the ratio of the dust content between "unclean side" and "clean side" when a dust source is provided on the unclean side. The device therefore gives better protection, the higher the protection factor.

For personnel protection, the workbench center 5 cm in front of the workbench opening (personnel area 1) is regarded as the clean side, and the workbench interior behind the suction arrangement (product area 2) is regarded as the unclean side. For assessing product protection, the unclean and clean sides are correspondingly reversed.

The protection factor is the ratio of the quantity of air borne particles in a contaminated area to the quantity of particles in a protected area. The protection factor for personnel protection is 400,000 when the workbench is in the rest state, i.e. without intervention by the operator. With simulated work movements, i.e. moving the hands in and out, and other movements of both arms in the booth, a value of 750 is obtained for personnel protection.

The protection factor for product protection is 160 million when the workbench is in the rest state, i.e. without intervention by the operator. With simulated work movements, i.e. moving the hands in and out, and other movements of both arms in the booth, a value of 6,000 is obtained for product protection.

EXAMPLE 2

Figure 2:
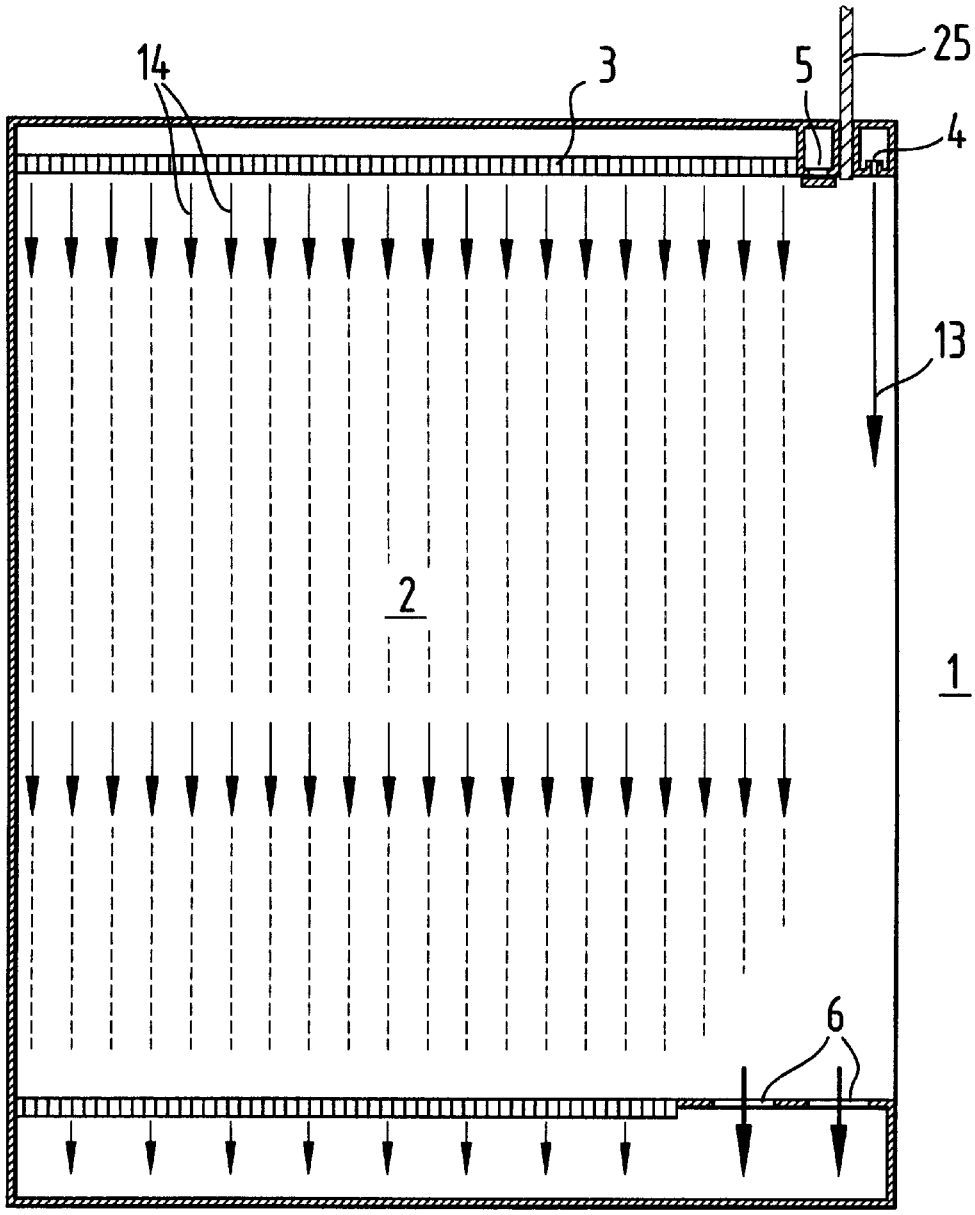
FIG. 2 shows a diagrammatic representation of a device and of a method in accordance with Example 2.

A workbench is constructed and operated as in Example 1. In contrast to Example 1, however, the gap between laminar flow generators 3 and raised screen is sealed off, so that no air escapes from ejector 5. Ejector 4 is operated, as in Example 1, at an air outlet velocity of 5 m/s. The planar air jet consequently has an air outlet capacity of 6.3 li.N. per second and meter breadth of the air jet. The air distribution in the work bench is shown diagrammatically in cross section in FIG. 2 below.

The protection factor for personnel protection is now 300 when the workbench is in the rest state, i.e. without intervention by the operator. With simulated work movements, i.e. moving the hands in and out, and other movements of both arms in the booth, a value of 30 is obtained for personnel protection.

The protection factor for product protection is now 50 million when the workbench is in the rest state, i.e. without intervention by the operator. With simulated work movements, i.e. moving the hands in and out, and other movements of both arms in the booth, a value of 40 is obtained for product protection.

COUNTER EXAMPLE 1

Figure 3:
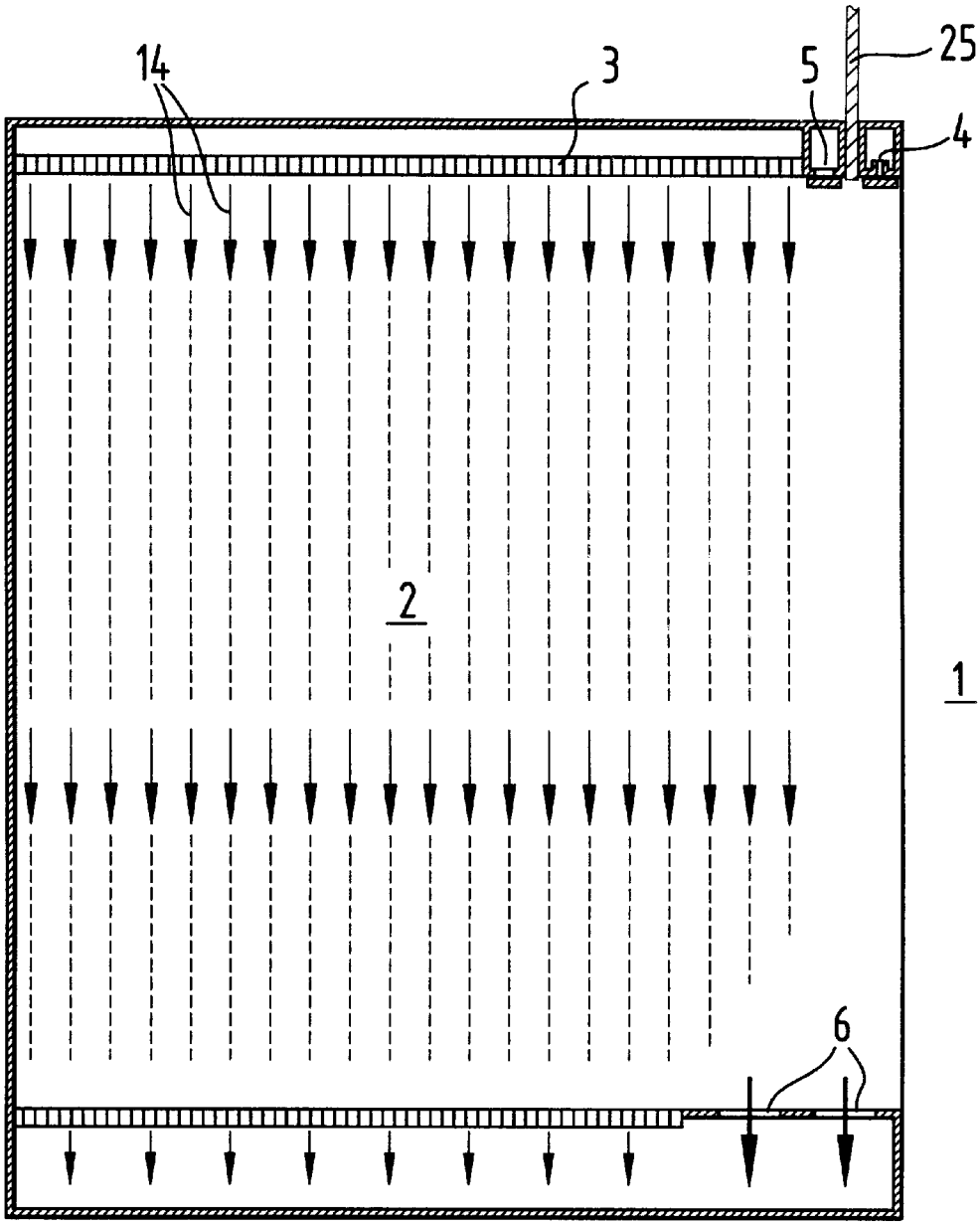
FIG. 3 shows a diagrammatic representation of a device and of a method in accordance with Counter Example 1.

A workbench is constructed and operated as in Example 1. In contrast to Example 1, however, the gap between laminar flow generators 3 and raised screen is sealed off, so that no air escapes from ejector 5. Ejector 4 is also not operated, so that no air escapes from it either. The air distribution in the work bench is shown diagrammatically in cross section in FIG. 3.

The protection factor for personnel protection is now 20 when the workbench is in the rest state, i.e. without intervention by the operator. With simulated work movements, i.e. moving the hands in and out, and other movements of both arms in the booth, a value of 10 is obtained for personnel protection.

The protection factor for product protection is now 6000 when the workbench is in the rest state, i.e. without intervention by the operator. With simulated work movements, i.e. moving the hands in and out, and other movements of both arms in the booth, a value of 30 is obtained for product protection.

EXAMPLE 3

A device for combined product protection and personnel protection is made up of an air delivery element 19 and an air suction element 20, as shown diagramatically in FIGS. 4*a* and 4*b*. Both elements stand in a room (not shown) with separate clean air supply system and exhaust system with integrated air cleaning (not shown). The open and at the same time protected product area 2 in which dust-producing products can be handled openly is situated in this device between the air delivery element 19 and the air suction element 20, as shown in FIG. 4*c*. The protected personnel area 1 is located in the entire spatial area surrounding the protected product area.

The air delivery element 19 consists essentially of an air admission pipe 7, into which purified air is fed from the delivery system, a distributor 8, a downwardly angled air delivery segment 22, and an upright segment 9. The air delivery segment 22 conveys the air delivered via the distributor on the one hand via a rectangular laminar flow generator 10 and on the other hand via four ejector rails 11, which enclose the laminar flow generator 10, in the direction of the suction element 20. The air velocity of the air delivered by the laminar flow generator 10 is 0.45 m/s in this example. The air outlet velocity from the ejector rails is 5 m/s in this example. The resulting air distribution at the air delivery element 19 is likewise shown diagrammatically in FIGS. 4*a* and 4*b*.

The air suction element 20 has two suction rails 12 via which 1.4 times the air quantity delivered by the air delivery element can be suctioned off and conveyed to the extraction system.

EXAMPLE 4

A mobile device for the combined protection of personnel and products protection is shown diagramatically in cross section in FIG. 5. The device has a protected product area 2 which is open both to the sides and also in the upper front area. The protected personnel area 1 comprises the area surrounding the device. Side openings can be used to supply the product area with product containers, whereas the front opening gives the person shown free access for protected handling of products 26.

Situated in the front ceiling area of the device there are two parallel ejector rails via which a planar air jet 13 can be delivered downward at an angle of about 100 to the vertical front face of the device. Behind these in the ceiling/ area there are laminar flow generators which can form a downward low-turbulence displacement stream 14. The delivered air is taken up, on the one hand, in the front area of the device, via an exhaust air channel 18 which is provided at the top with suction openings, and, on the other hand, in the lower rear area of the product area, at the base of the device and fed to a filter 16 via a fan 15. Some of the purified air flowing from the filter serves as intake air 21 for the laminar flow generator and the ejector rails and some of it is discharged as exhaust air 17.

What is claimed is:

1. A method for separating at least two spatial areas (1, 2) and for reducing the transmission of airborne particles between the spatial areas (1, 2) in order to protect persons and/or products (26) from the airborne particles, the person being located at least in part in the first spatial area (1) and the products in the second spatial area (2), and at least one planar air jet (13) of purified air being used for the separation, in which at least one low-turbulence displacement stream (14) is generated with purified air near the at least one air jet (13) in at least the second spatial area (2), said at least one displacement stream (14) being directed in essentially the same direction as the at least one air jet (13), wherein at least two planar air jets (13) with an air outlet velocity of 2 to 30 m/s are generated for the separation.

2. The method as claimed in claim 1, in which the displacement stream (14) is guided at least partially at a distance of at most 0 to 50 cm from the at least one air jet (13).

3. The method as claimed in claim 1, in which at least one displacement stream (14) with an air velocity of 0.1 to 1.5 m/s is generated.

4. The method as claimed in claim 1, in which an air jet (13) or a displacement stream (14) is generated with an air outlet capacity of at least 10 li.N. per second per meter breadth of the air jet (13) transverse to the direction of flow.

5. The method as claimed in claim 1, in which at least the second spatial area (2) has untraversed zones.

6. The method as claimed in claim 1, in which at least the total air quantity of the at least one air jet (13) and of the at least one displacement stream (14) is suctioned off in at least one of the spatial areas (1,2).

7. The method as claimed in claim 1, in which the air jet or each air jet (13) is oriented at an angle, from the range of −45° to +45° toward a lateral face of the displacement stream (14), relative to the direction of flow.

8. A device for carrying out the method as claimed in claim 1, having one or more first means (4, 5) for generating one or more planar air jets (13), with which, in its intended use, at least one space is divided into at least a first spatial area (1) and a second spatial area (2) by means of the planar air jet or by means of each planar air jet (13), and products (26) being able to be arranged in the second spatial area (2), the device in the second spatial area (2) having second means (3) for generating a low-turbulence displacement stream (14).

9. The device as claimed in claim 8, in which the device has one or more suction arrangements (6, 15) which are dimensioned such that altogether they can suction off at least the total air quantity of the air jets (13) and of the displacement streams (14).

10. The device as claimed in claim 9, in which the suction arrangement or each suction arrangement (6, 15) is arranged opposite the first means (4, 5) for generating the air jets (13) or the displacement flow (14).

11. The method as claimed in claim 8, which the second means (3) are arranged and designed such that the displacement stream (14) can be guided at least partially at a distance of at most 0 to 50 cm from the least one air jet (13).

12. The device as claimed in claim 8, in which the second means (3) are designed such that a displacement stream (14) with an air velocity of 0.1 to 1.5 m/s can be generated.

13. The device as claimed in claim 8, in which the first means (4, 5) are designed such that an air jet (13) with an air outlet velocity of 2 to 30 m/s can be generated.

14. The device as claimed in claim 8, in which the means (4,5) for generating the air jets (13) are dimensioned such that planar air jets with an air outlet capacity of at least 10 li.N. per second and breadth B of the planar air jet can be generated.

15. The device as claimed in claim 8, in which the means (4, 5) for generating the air jet (13) or each air jet are arranged and oriented such that the air jet or each air jet (13) can be oriented at an angle, from the range of −45° to +45° toward a lateral face of the displacement stream (14), relative to the direction of flow.

16. The device as claimed in claim 8, in which the means (4, 5) for generating the air jet or each air jet (13) are designed as ejector rails.

17. The device as claimed in claim 16, in which at least two ejector rails are arranged in parallel.

18. A device for implementing the method as claimed in claim 1, having a partially open front with a height of H for access to the device, two side walls, a rear wall, one or more means for blowing in filtered air, which means are arranged on a side wall, and one or more suction devices, wherein the blowing-in means are designed and arranged, on the one hand, such that at least two planar air jets with an air outlet velocity of 2 to 30 m/s and with an air outlet capacity in each case of in all more than 10 li.N. per second and height H can be guided from the area of one side wall near the front to the other side wall in order to separate the internal space of the device from the surrounding area, and, on the other hand, such that, on that side of the air jets facing away from the front, a purified, low-turbulence displacement stream can be guided from one side wall to the other, and wherein the suction devices are arranged at least partially in the area of the device near the front and are dimensioned such that altogether they can take up at least the total air quantity of the air jets and of the displacement stream.

19. The device as claimed in claim 18, wherein the air jets can be guided at a predetermined or selectable or adjustable angle, from the arrange of −45° to +45° toward the front face of the displacement stream, relative to the direction of flow.

20. The device as claimed in claim 18, wherein the air outlet capacity is 10 to 300 li.N. per second per meter height of that part of the front provided for access.

21. A device for implementing the method as claimed in claim 1, having a partially open front with a breadth of B for access to the device, a top, a base, a rear wall, one or more means for blowing in filtered air, which means are arranged on the top, and one for more suction devices, wherein the blowing in means are designed and arranged, on the one hand (4, 5), such that at least two planar air jets with an air outlet velocity of 2 to 30 m/s and with an air outlet capacity in each case of in all more than 10 li.N. per second and breadth B can be guided downward from the area of the top near the front in order to separate the internal space (2) of the device from the surrounding area (1), and, on the other hand (3), such that, on that side of the air jet (13) facing away from the front, a purified, low-turbulence displacement stream (14) can be guided downward, and wherein the suction devices (6) are arranged at least partially in the area of the device near the front and are dimensioned such that altogether they can take up at least the total air quantity of the air jets (13) and of the displacement stream (14).

22. A device for implementing the method as claimed in claim 1, having a partially open front with a breadth of B for access to the device, a bottom, a top, a base, a rear wall, one or more means for blowing in filtered air, which means are arranged on the bottom, and one or more suction devices, wherein the blowing-in means are designed and arranged, on the one hand, such that at least two planar air jets with an air outlet velocity of 2 to 30 m/s and with an air outlet capacity in each case of in all more than 10 li.N. per second and breadth B can be guided upward from the area of the bottom near the front in order to separate the internal space from the device on the surrounding area, and, on the other hand, such that, on that side of the air jet facing away from the front, a purified, low-turbulence displacement stream can be guided upward, and wherein the suction devices are arranged at least partially in the area of the device near the front and are dimensioned such that altogether they can take up at least the total air quantity of the air jets and of the displacement stream.

23. The device as claimed in claim 21, wherein the air jet can be guided at an angle, from the range of −45° to +45° toward the front face of the displacement stream, relative to the direction of flow.

24. The device as claimed in claim 21, wherein the air outlet capacity is 10 to 300 liters per second per meter breadth of that part of the front provided for access.

25. The device as claimed in claim 18, in which the device has a displaceable screen (25) on the front.

* * * * *

UNITED STATES PATENT AND TRADEMARK OFFICE

CERTIFICATE OF CORRECTION

PATENT NO. : 6,626,971 B1
DATED : September 30, 2003
INVENTOR(S) : Forbert Rainald et al.

It is certified that error appears in the above-identified patent and that said Letters Patent is hereby corrected as shown below:

Column 8,
Line 34, delete “essentially”.
Line 58, should read -- A device for carrying out the method as claimed in claim 1, having at least two first means (4, 5) for generating several planar air jets (13) with an air outlet velocity of 2 to 30 m/s, with which, in its intended use, at least one space is divided into at least a first spatial area (1) and a second spatial area (2) by means of the planar air jet or by means of each planar air jet (13), and products (26) being able to be arranged in the second spatial area (2), the device in the second spatial area (2) having second means (3) for generating a low-turbulence displacement stream (14). --.

Column 9,
Line 13, after “the” insert -- at --.

Signed and Sealed this

Thirtieth Day of December, 2003

JAMES E. ROGAN
*Director of the United States Patent and Trademark Office*